US012173431B2

(12) United States Patent
Sudre et al.

(10) Patent No.: US 12,173,431 B2
(45) Date of Patent: Dec. 24, 2024

(54) FABRIC STRUCTURE CONTROL USING ULTRASONIC PROBE

(71) Applicant: Raytheon Technologies Corporation, Farmington, CT (US)

(72) Inventors: Olivier H. Sudre, Glastonbury, CT (US); Sarah Annette Frith, Layton, UT (US); John E. Holowczak, South Windsor, CT (US); Mary Colby, West Hartford, CT (US); Ying She, Rocky Hill, CT (US); Kathryn S. Read, Marlborough, CT (US)

(73) Assignee: RTX Corporation, Farmington, CT (US)

( * ) Notice: Subject to any disclaimer, the term of this patent is extended or adjusted under 35 U.S.C. 154(b) by 227 days.

(21) Appl. No.: 18/082,819

(22) Filed: Dec. 16, 2022

(65) Prior Publication Data

US 2023/0193525 A1 Jun. 22, 2023

Related U.S. Application Data

(60) Provisional application No. 63/291,777, filed on Dec. 20, 2021.

(51) Int. Cl.
*D02J 1/18* (2006.01)
*D02J 1/16* (2006.01)
(Continued)

(52) U.S. Cl.
CPC . *D02J 1/18* (2013.01); *D02J 1/16* (2013.01); *D03D 13/00* (2013.01); *D03D 15/242* (2021.01); *D06C 29/00* (2013.01)

(58) Field of Classification Search
CPC ..... D02J 1/18; D02J 1/16; D06C 3/00; D06C 19/00; D06C 23/00; D06C 27/00;
(Continued)

(56) References Cited

U.S. PATENT DOCUMENTS 3,084,020 A * 4/1963 Loosli ..... D02G 1/00 8/150
3,713,729 A * 1/1973 Inoue ..... C03B 37/14 385/115
(Continued)

FOREIGN PATENT DOCUMENTS

CN 103951455 A 7/2014
CN 109736071 A 5/2019
(Continued)

OTHER PUBLICATIONS

Extended European Search Report for EP Application No. 22213436.3, dated May 17, 2023, 10 pages.
(Continued)

*Primary Examiner* — Amy Vanatta
(74) *Attorney, Agent, or Firm* — Kinney & Lange, P.A.

(57) ABSTRACT

A method of spreading fiber tows includes applying a coupling medium to a surface of a fibrous structure, positioning an ultrasonic probe adjacent to the surface of a fibrous structure, such that a tip of the ultrasonic probe is in contact with the coupling medium, moving at least one of the ultrasonic probe and the fabric structure relative to the other of the ultrasonic probe and the fibrous structure according to a first pattern, and imparting ultrasonic vibration with the ultrasonic probe to the surface of the fibrous structure while moving the ultrasonic probe along the surface of the fibrous structure. Imparting ultrasonic vibration to the surface of the fibrous structure spreads tows of the fibrous structure.

20 Claims, 5 Drawing Sheets

(51) Int. Cl.
*D03D 13/00* (2006.01)
*D03D 15/242* (2021.01)
*D06C 29/00* (2006.01)

(58) Field of Classification Search
CPC .... D06C 29/00; D06C 2700/31; D03D 13/00; D03D 15/242; D01D 11/02; D06B 13/00; D06M 10/02
USPC ..... 28/165, 282, 283, 167; 26/27, 51
See application file for complete search history.

(56) References Cited

U.S. PATENT DOCUMENTS

| | | | | |
|---|---|---|---|---|
| 3,798,095 | A * | 3/1974 | Hall | D02J 1/18 28/282 |
| 4,302,485 | A * | 11/1981 | Last | D06M 10/02 427/601 |
| 4,902,326 | A | 2/1990 | Jarmon | |
| 5,016,451 | A * | 5/1991 | Tsukabayashi | D06M 10/02 68/2 |
| 5,123,373 | A * | 6/1992 | Iyer | D06M 23/06 118/DIG. 5 |
| 5,511,395 | A * | 4/1996 | Hamade | D06B 13/00 68/2 |
| 6,180,232 | B1 | 1/2001 | McCullough et al. | |
| 6,485,796 | B1 | 11/2002 | Carpenter et al. | |
| 7,022,179 | B1 | 4/2006 | Dry | |
| 7,832,983 | B2 | 11/2010 | Kruckenberg et al. | |
| 8,161,607 | B2 * | 4/2012 | Hirai | D06C 29/00 28/165 |
| 9,758,908 | B2 | 9/2017 | Le Costaouec et al. | |
| 9,908,820 | B2 | 3/2018 | Sheedy et al. | |
| 2007/0023099 | A1 * | 2/2007 | Homma | D06C 15/00 139/426 R |
| 2014/0050862 | A1 * | 2/2014 | Borger | D06M 10/02 427/560 |
| 2015/0345050 | A1 * | 12/2015 | Wilson | D02J 1/18 118/100 |
| 2016/0068446 | A1 | 3/2016 | Sheedy et al. | |
| 2017/0037545 | A1 * | 2/2017 | Keppel | D02J 1/18 |
| 2018/0313027 | A1 * | 11/2018 | Horimoto | D06M 10/02 |

FOREIGN PATENT DOCUMENTS

| | | | | |
|---|---|---|---|---|
| DE | 102018112168 | A1 * | 11/2018 | B05B 17/0646 |
| EP | 0302449 | A2 | 2/1989 | |
| EP | 0688893 | A2 * | 12/1995 | |
| EP | 2175060 | A1 | 4/2010 | |
| EP | 3181744 | A1 | 6/2017 | |
| EP | 3502307 | A1 | 6/2019 | |
| EP | 3640022 | A1 | 4/2020 | |
| JP | H02307965 | A | 12/1990 | |
| JP | 2001316971 | A | 11/2001 | |
| JP | 2003268669 | A | 9/2003 | |
| JP | 2014070325 | A * | 4/2014 | |
| WO | 9412708 | A1 | 6/1994 | |
| WO | WO-0075410 | A1 * | 12/2000 | D06C 27/00 |
| WO | 0231242 | A1 | 4/2002 | |
| WO | WO-2008081360 | A1 * | 7/2008 | D06B 13/00 |
| WO | 2020213078 | A1 | 10/2020 | |
| WO | WO-2021165121 | A1 * | 8/2021 | |

OTHER PUBLICATIONS

Extended European Search Report for EP Application No. 22214993.2, dated Jun. 7, 2023, 11 pages.

* cited by examiner

FABRIC STRUCTURE CONTROL USING ULTRASONIC PROBE

CROSS-REFERENCE TO RELATED APPLICATION(S)

This application claims the benefit of U.S. Provisional Application No. 63/291,777 filed Dec. 20, 2021 for "FABRIC STRUCTURE CONTROL USING ULTRASONIC PROBE" by O. Sudre, S. Frith, J. Holowczak, M. Colby, Y. She, and K. Read.

BACKGROUND

The present disclosure relates to ceramic matrix composites, and more particularly, to the preparation of woven ceramic fabrics for use in ceramic matrix composites.

In the processing of ceramic matrix composites (CMCs), there is a need to infiltrate matrix within and around tows. In a woven CMC system, pores or voids through which matrix can infiltrate can be non-uniform in size. Non-uniformity of pore size can reduce the uniformity of infiltration, potentially resulting in defects in the resulting CMC components.

SUMMARY

In one example, a method of spreading fiber tows includes applying a coupling medium to a surface of a fibrous structure, positioning an ultrasonic probe adjacent to the surface of a fibrous structure, such that a tip of the ultrasonic probe is in contact with in the coupling medium, moving the ultrasonic probe along the surface of the fibrous structure according to a first pattern, and imparting ultrasonic vibration with the ultrasonic probe to the surface of the fibrous structure while moving the ultrasonic probe along the surface of the fibrous structure. Imparting ultrasonic vibration to the surface of the fibrous structure spreads tows of the fibrous structure.

In another example, a system for spreading fiber tows includes a fibrous structure, a layer of a coupling medium on a surface of the fibrous structure, and an ultrasonic probe is in contact with the layer of the coupling medium. The ultrasonic probe is configured to impart ultrasonic vibration to the woven fabric sheet through the coupling liquid layer, while at least touching the layer of the coupling medium, and the ultrasonic vibration is directed to cause tows adjacent to the ultrasonic probe to spread apart. At least one of the ultrasonic probe and the fabric structure the ultrasonic probe is configured to be moved relative to the other of the at least one of the ultrasonic probe and the fabric structure according to a first pattern.

The present summary is provided only by way of example, and not limitation. Other aspects of the present disclosure will be appreciated in view of the entirety of the present disclosure, including the entire text, claims, and accompanying figures.

Figure 1:
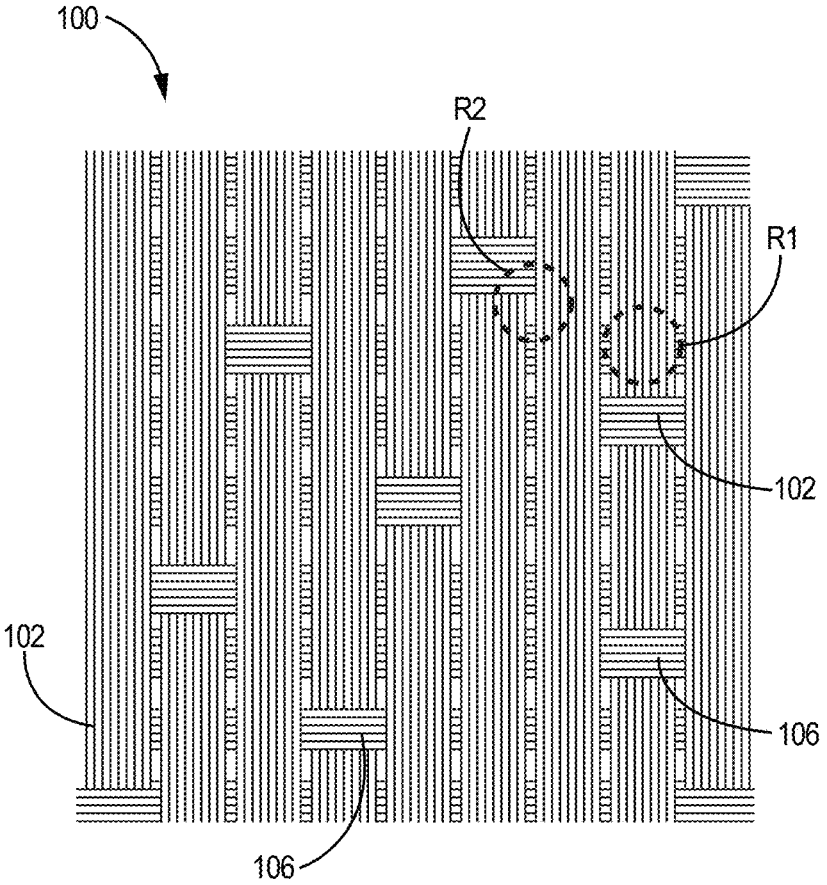
FIG. 1 is a schematic drawing of an example of a woven fabric sheet.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

The present disclosure includes systems and methods of spreading the fabric tows using ultrasonic vibration. The systems and methods disclosed herein advantageously allow for improved uniformity of densification of fabric structures, improving various characteristic of resulting CMC components. Further, the systems and methods disclosed herein advantageously allow for tow spreading of woven fabrics, such as woven fabric sheets, preforms, woven fabric tapes, and/or components having unidirectional fabric tows as well as multilayer and multi-dimensional fabrics.

FIG. 1 is a schematic drawing of fibrous structure 100. Fibrous structure 100 is formed from tows 102 and includes intra-tow regions R1 and inter-tow regions R2. Tows 102 are bundles of ceramic filaments. The ceramic material can be, for example, carbon, silicon carbide, alumina, mullite or another suitable material. Intra-tow regions R1 are regions within a given tow 102 and inter-tow regions R2 are regions between adjacent pairs of tows 102.

In the depicted example, fibrous structure 100 is a woven fabric sheet having warp and weft (i.e., typically substantially perpendicular) tows 102. Where fibrous structure 100 is a woven structure, tows 102 can be arranged in various woven architectures such as plain, harness (e.g., 3, 5, 8, etc.), twill, or non-symmetric, among other examples. In other examples, fibrous structure 100 can adopt other shapes and/or forms, such as braided fabric structures, fibrous preforms, fabric tapes, three-dimensional fabric structures, multilayer fabrics, individual fiber tows, or unidirectional fiber materials. Where fibrous structure 100 is formed as a braided structure of tows 102, the braided structure can be, for example, a biaxial or triaxial braid and can be formed on, for example, a mandrel. Additionally and/or alternatively, fibrous structure 100 can be a three-dimensional fibrous structure, such as a three-dimensional fabric preform. The three-dimensional fibrous structure can be for example, a cylinder or another suitable structure.

As shown in FIG. 1, the pore size of fibrous structure 100 follows a bimodal distribution, with the pore size of intra-tow regions R1 forming a first mode of the bimodal distribution and the pore size of inter-tow regions R2 forming the second mode of the bimodal distribution. The pore size of intra-tow regions R1 is defined by the spacing between filaments of tows 102, which the pore size of inter-tow regions R2 is defined by the spacing of tows 102 in the weave of fibrous structure 100. In typical woven fabric sheets, the pore size of intra-tow regions R1 is substantially smaller than the pore size of inter-tow regions R2. Fibrous structure 100 also includes crossover points 106, which are points at which intersecting warp and weft tows 102 alternate being under or over one another, forming the weave of fibrous structure 100. Fibrous structure 100 is generally thicker at crossover points 106 than at other regions of fibrous structure 100.

Fibrous structure 100 can undergo matrix formation and densification using, for example, a chemical vapor infiltration (CVI) process, a deposition (CVD) process, a polymer infiltration and pyrolysis process (PIP), a melt infiltration process (MI), or a combination of two or more of CVI, CVI, PIP, and MI. During densification, tows 102 are infiltrated by reactant vapors and a gaseous precursor deposits on the filaments of tows 102. The resulting matrix material can be a silicon carbide or other suitable ceramic material. Densification is carried out until the resulting CMC has reached the desired residual porosity.

The pore size of intra-tow regions R1 and inter-tow regions R2 has a significant effect on densification uniformity of fibrous structure 100. In particular, the bimodal distribution of pore size, with relatively small pore sizes in intra-tow region R1 and relatively large pore sizes in inter-tow regions R2, significantly reduces the uniformity of densification of fibrous structure 100. Improving the uniformity of densification of fibrous structure 100 advantageously improves a number of properties of the resulting CMC. For example, improving densification uniformity can decrease the overall porosity of the resulting CMC and/or improve the threshold for matrix cracking and strength.

Figure 2A:
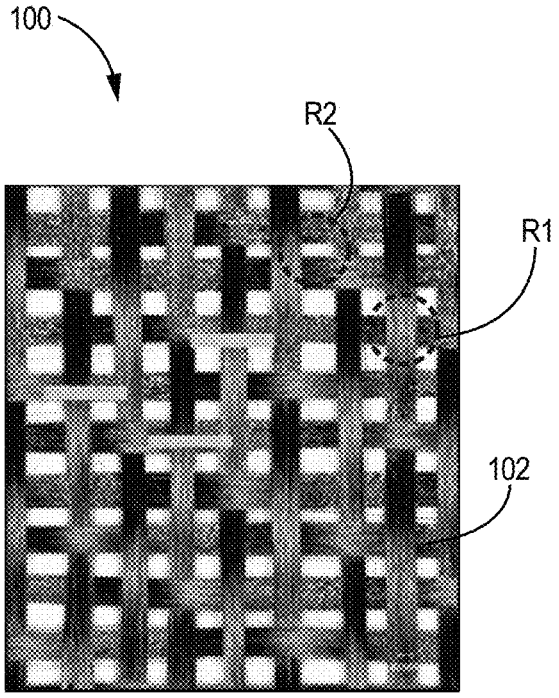
FIG. 2A is a close-up view of a further example of a woven fabric sheet.
Figure 2B:
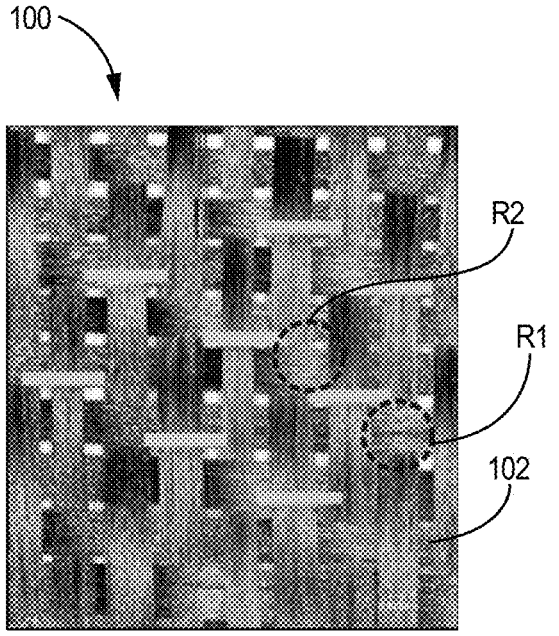
FIG. 2B is a close-up view of the woven fabric sheet of FIG. 2A following ultrasonic vibration.

FIGS. 2A and 2B are images of fibrous structure 100 prior to and following tow spreading with ultrasonic vibration, respectively. FIGS. 2A and 2B will be discussed together. Ultrasonic vibration can be used to spread tows 102 of fibrous structure 100. Following tow spreading with ultrasonic vibration (FIG. 2B), the pore size in intra-tow regions R1 increases substantially and the pore size in inter-tow regions R2 decreases substantially. To this extent, tow spreading with ultrasonic vibration homogenizes pore size in intra-tow regions R1 and inter-tow regions R2. Consequently, tow spreading with ultrasonic vibration improves densification uniformity of fibrous structure 100, advantageously reducing the overall porosity of the resulting CMC and/or improve the threshold for matrix cracking and strength. Further, fibrous structures constructed using tows 102 spread with ultrasonic vibration are especially useful for exterior surfaces of gas turbine engine components interfacing with an airstream, in particular, an airfoil, a blade outer air seal, and/or a strut. In particular, spreading of tows 102 flattens the overall structure of tows 102, reducing the surface roughness of components made from the spread tows 102. The reduced macro surface roughness CMC components of a gas turbine engine reduce disruptions to the airstream flowing over its exterior surfaces.

Notably, during the tow spreading of fibrous structure 100 depicted in FIGS. 2A and 2B, the ends-per-inch (EPI) and picks-per-inch (PPI) do not change substantially. Rather, tow spreading of fibrous structure 100 only affects the relative spacing of filaments of tows 102.

Figure 3:
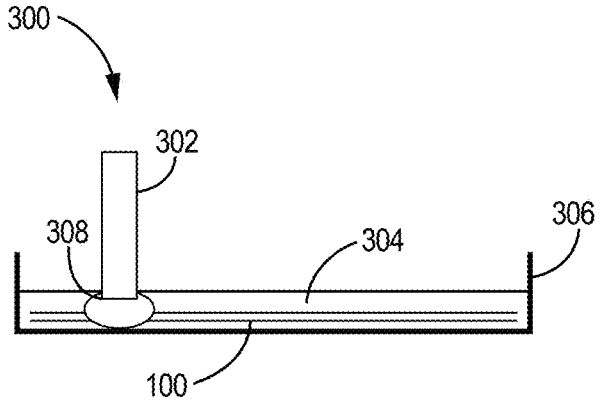
FIG. 3 is a schematic drawing of an example of a system for imparting ultrasonic vibration to a woven fabric sheet.
Figure 4:
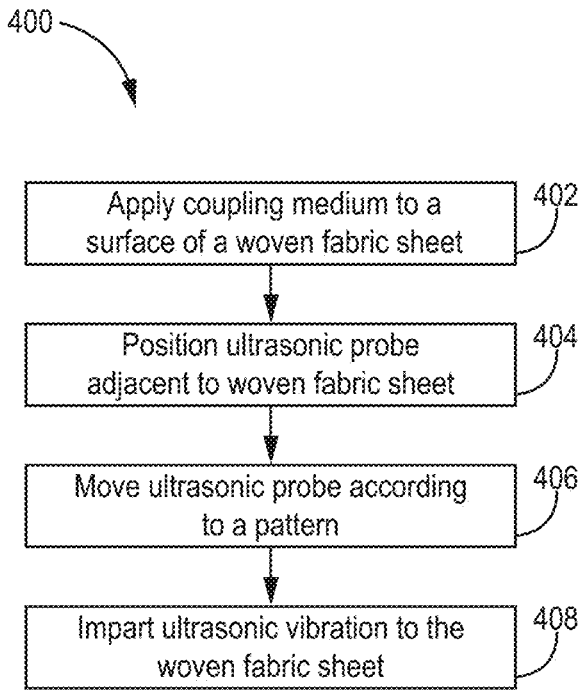
FIG. 4 is a flow diagram of an example of a method of spreading tows of a woven fabric sheet using the system of FIG. 3.
Figure 5:
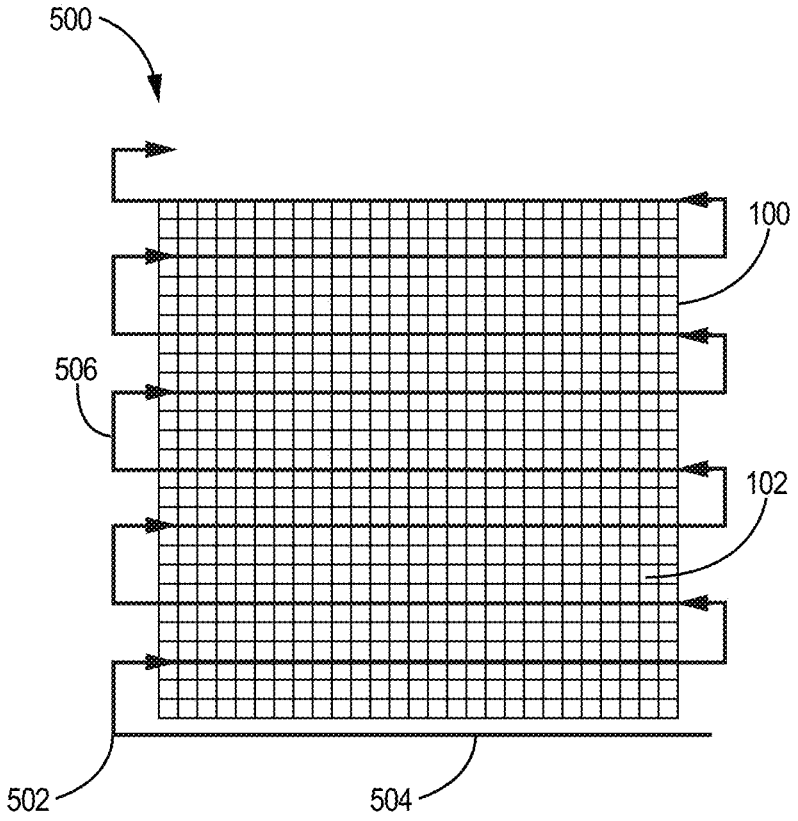
FIG. 5 is a schematic drawing of a pattern for imparting ultrasonic vibration that can be used with the method of FIG. 4.

FIG. 3 is a schematic drawing of system 300, which is capable of imparting ultrasonic vibration to fibrous structure 100. FIG. 4 is a flow diagram of method 400, which is a method of spreading fiber tows using system 300 and includes steps 402-408, which will be described in more detail subsequently. FIG. 5 is a schematic drawing of pattern 500, which is one example of a pattern for imparting ultrasonic vibration that can be used in step 406 of method 400. Pattern 500 includes arrows 502, which include scroll portions 504 and step portions 506. FIGS. 3-5 will be discussed together.

System 300 includes ultrasonic probe 302, coupling medium 304, and bath 306. Ultrasonic probe 302 includes tip 308. Ultrasonic probe 302 is configured to generate emit ultrasonic vibration from tip 308, which is disposed at an end of ultrasonic probe 302. Ultrasonic probe 302 can further include a power source (not shown) for providing power and/or a control system (not shown) for controlling the operation of ultrasonic probe 302, such as for controlling the amplitude and/or frequency of ultrasonic vibrations created at tip 308. Fibrous structure 100 is submerged in coupling medium 304. Coupling medium 304 functions to convey ultrasonic vibration from tip 308 to a surface of fibrous structure 100. Coupling medium 304 can be a liquid medium, such as water, or a gaseous medium, such as air. In the depicted example, tip 308 of ultrasonic probe 302 is substantially circular and has a width W. However, tip 308 can have any suitable shape, including non-circular shapes. In operation, tip 308 is in contact with in coupling medium 304 and is positioned adjacent to a surface of fibrous structure 100 at a distance D from the surface of fibrous structure 100. Bath 306 is sized and configured to allow fibrous structure 100 to be completely submerged in coupling medium 304.

Method 400 is a method of spreading fiber tows using system 300 and includes steps of applying a coupling medium to a surface of a woven fabric sheet (step 402), positioning a tip of an ultrasonic probe adjacent the surface of the woven fabric sheet (step 404), moving the tip of the ultrasonic probe according to a pattern (step 406), and imparting ultrasonic vibration to the woven fabric sheet (step 408).

In step 402, a coupling medium is applied to fibrous structure 100. The coupling medium can be applied, by form example, wetting fibrous structure 100 with a liquid coupling medium. Fibrous structure 100 can be wetted with coupling medium 304 by, for example, submerging woven fabric sheet in coupling medium 304 in bath 306. Alternatively, coupling medium 304 can be applied to fibrous structure 100 by, for example, soaking fibrous structure 100 with coupling medium 304. In step 404, tip 308 of ultrasonic probe 302 is positioned adjacent to the surface of fibrous structure 100. More specifically, tip 308 is in contact with in coupling medium 304 and positioned distance D away from the surface of fibrous structure 100.

In step 406, tip 308 of ultrasonic probe 302 is moved according to a pattern. The pattern can be any suitable pattern for imparting ultrasonic vibration to the surface of fibrous structure 100. FIG. 5 is a schematic drawing of pattern 500, which is one example of a pattern for imparting ultrasonic vibration that can be used in step 406 of method 400. Pattern 500 includes arrows 502, which include scroll portions 504 and step portions 506. Scroll portions 504 of pattern 500 are parallel to one of either the warp or weft tows 102 of fibrous structure 100 and extend across at least the entire extent of fibrous structure 100. Step portions 506 of pattern 500 are parallel to the other of the warp and weft tows of fibrous structure 100, and extend for less than the entire extent of fibrous structure 100.

The movement of tip 308 of ultrasonic probe 302 in pattern 500 is shown by arrows 502. According to arrows 502, tip 308 is moved through alternating scroll portions 504 and step portions 506. To this extent, pattern 500 is a two-dimensional pattern, with one dimension corresponding to scroll portions 504 and one dimension corresponding to step portions 506. More specifically, tip 308 is first moved in a first direction parallel to either the warp tows or the weft tows of fibrous structure 100, and is moved across the entire extent of fibrous structure 100. Tip 308 is then stepped (i.e., shifted laterally) in a second direction parallel to the other of the warp and the weft tows. After tip 308 is stepped, tip 308 is moved back across the entire extent of fibrous structure 100 in a third direction antiparallel to the first direction. After tip 308 is moved in the third direction, tip 308 is again stepped in the second direction. The above-described pattern is then repeated until tip 308 has been moved across the entire extent of fibrous structure 100 in the second direction. In some examples, tip 308 is moved away from and is not adjacent to the surface of fibrous structure 100 as tip 308 is stepped.

Pattern 500 can be repeated multiple times in the same relative to the warp and weft tows of fibrous structure 100. For example, pattern 500 can be repeated multiple times in the same orientation relative to fibrous structure 100 to so that tip 308 has multiple passes over the portions of the surface of fibrous structure 100 covered by pattern 500. Ultrasonic vibrations imparted by tip 308 can cause heating of tip 308 and coupling medium 304. Multiple passes allow for additional ultrasonic vibration to be applied to the portions of the surface of fibrous structure 100 covered by pattern 500 while maintaining the temperature of the ultrasonic tip and liquid medium in an acceptable range.

As a further example, pattern 500 can be repeated in different orientations relative to the warp and weft tows of fibrous structure 100. Tip 308 can first be moved according to pattern 500 as outlined above such that scroll portions 504 are parallel to one of the warp and weft tows of fibrous structure 100. Pattern 500 can then be repeated at a 90-degree angle relative to the previous iteration of pattern 500, such that the scroll portions 504 of pattern 500 are parallel to the other of the warp and weft tows of fibrous structure 100 (i.e., such that the scroll portions 504 of the two iterations are offset by 90 degrees and form a checkerboard pattern). Advantageously, repeating pattern 500 in different orientations relative to the warp and weft tows of fibrous structure 100 allows for the amount of fibrous structure 100 that is subject to ultrasonic vibration to be increased (i.e., by allowing application of ultrasonic vibration to portions of fibrous structure 100 between step portions 506 of pattern 500) without requiring adjustment of the length of scroll portions 504 and/or step portions 506 of pattern 500.

In some examples, pattern 500 can also be performed at an angle intermediate to the directions of the warp and weft tows 102. For example, pattern 500 can be performed such that scroll portions 504 are offset by 45 degrees from the warp and weft tows 102 of fibrous structure 100. In these examples, pattern 500 can also be repeated in the same orientation or in different orientations, as described previously. As a further example, tip 308 can be moved in a first direction at an angle intermediate to the directions of the warp and the weft tows 102. After tip 308 has moved across an entire extend of fibrous structure 100 in the first direction, tip 308 can then be stepped in a second direction perpendicular to the first direction. tip 308 is moved back across the entire extent of fibrous structure 100 in a third direction antiparallel to the first direction. After tip 308 is moved in the third direction, tip 308 can again be stepped in the second direction. The above-described pattern can then be repeated until tip 308 has been moved across the entire extent of fibrous structure 100 in the second direction.

Although in FIG. 5 step portions 506 of pattern 500 are depicted as spanning multiple tows 102 of fibrous structure 100, the size of step portions 506 can in some examples be selected such to match the spacing of tows 102 in fibrous structure 100, such that ultrasonic probe 302 passes over each tow of fibrous structure 100 individually. Advantageously, this ensures that each tow of fibrous structure 100 receives ultrasonic vibration from tip 308.

Pattern 500 is only one example of a pattern that can be used in step 406 of method 400. In further examples, other patterns can be used besides pattern 500. The pattern used in step 406 can be varied to selectively impart ultrasonic vibrations to specific portions of fibrous structure 100 or to meet another operational requirement. In some examples, a random path may be advantageous to optimize the portion of the surface of fibrous structure 100 that receives ultrasonic vibrations. Although pattern 500 has been described herein as requiring continuous motion of tip 308 of ultrasonic probe 302, in some examples tip 308 can be discontinuously moved across fibrous structure 100 by, for example, moving tip 308 to different regions of fibrous structure 100 while tip 308 is not adjacent to the surface of fibrous structure 100.

Further, as crossover points 106 are thicker regions of fibrous structure 100, selecting pattern 500 to pass over crossover points 106 can help reduce the overall thickness of fibrous structure 100 following tow spreading. As warp and weft tows 102 intersect at crossover points 106, selecting pattern 500 to include crossover points 106 can also help constrain spreading of tows 100.

In step 408 of method 400, ultrasonic vibration is imparted to fibrous structure 100 through coupling medium 304 from tip 308. Steps 406 and 408 can be performed substantially simultaneously such ultrasonic vibration is imparted to fibrous structure 100 during step 408 as tip 308 is moved during step 406. After method 400 is performed, fibrous structure 100 can be dried and/or densified by, for example, one or more of CVI, CVI, PIP and MI. In other examples, fabric structure 100 can be separated and/or layed up to form a fabric preform prior to densification.

The ultrasonic vibration imparted to woven fabric sheet spreads tows 102 of fibrous structure 100 by increasing the spacing between filaments of tows 102. Advantageously, spreading tows 102 increases the intra-tow pore size and reduces the inter-tow pore size of fibrous structure 100. As such, spreading tows 102 of fibrous structure 100 improves the densification uniformity of fibrous structure 100, improving a number of properties of the resulting CMC. For example, improving densification uniformity can decrease the overall porosity of the resulting CMC and increase, with respect to the plane of fibrous structure 100, both the in-plane strength and the out-of-plane strength the resulting CMC. Further, fibrous structures constructed using tows 102 spread with ultrasonic vibration are especially useful for exterior surfaces of gas turbine engine components interfacing with an airstream, in particular, an airfoil, a blade outer air seal, and/or a strut. In particular, spreading of tows 102 flattens the overall structure of tows 102, reducing the surface roughness of components made from the spread tows 102. The reduced macro surface roughness CMC components of a gas turbine engine reduce disruptions to the airstream flowing over its exterior surfaces.

In some examples, it may be advantageous to preserve spacing in inter-tow regions R2. In these examples, the amount of ultrasonic vibration imparted to fibrous structure 100 during step 408 can be constrained to limit spreading of tows 102. The amount of ultrasonic vibration imparted to fibrous structure 100 can be constrained by, for example, constraining the power of ultrasonic vibrations imparted by tip 308, adjusting pattern 500, and/or adjusting the speed with which tip 308 is moved during step 406.

In examples where the spacing between tows 102 is large (i.e., the EPI or PPI is low), method 400 can be used to split individual tows 102 into two or more subtows. Advantageously, splitting tows 102 into subtows can improve infiltration and densification, increasing the strength of the resulting CMC.

Ultrasonic probe 302 can be operated in an uninterrupted manner to continuously deliver ultrasonic vibrations continuously during step 408 of method 400, or ultrasonic probe 302 can be operated selectively to pulse ultrasonic vibrations during step 408 of method 400. In some examples where ultrasonic probe 302 is operated to pulse ultrasonic vibrations, ultrasonic probe 302 can deliver 1 second pulses of ultrasonic vibration.

In some examples, fibrous structure 100 can be de-sized in a separate step prior to method 400. In examples where coupling medium 304 is water, de-sizing can occur substantially simultaneously with method 400. For example, if coupling medium 304 is water and the sizing is polyvinyl alcohol (PVA), coupling medium 304 can also perform de-sizing of fibrous structure 100, allowing de-sizing to occur substantially simultaneously with method 400.

Various parameters of system 300 and method 400 can be varied to optimize tow spreading. More specifically, one or more of distance D, width W, the composition of coupling medium 304, the depth of coupling medium 304, the amplitude of the ultrasonic vibrations emitted by ultrasonic probe 302, the frequency of the vibrations emitted by ultrasonic probe 302, the speed at which tip 308 is moved in step 406 of method 400, and the number of times that tip 308 is passed over fibrous structure 100 can be adjusted to optimize tow spreading.

The distance D between tip 308 and fibrous structure 100 can be selected to optimize tow spreading. More specifically, the distance D can be selected to optimize the area of application of ultrasonic vibration, and the temperature of fibrous structure 100. As distance D between tip 308 and fibrous structure 100 decreases, the strength of the ultrasonic vibration applied to fibrous structure 100 increases and the area of application decreases. Increasing the strength of the ultrasonic vibration imparted to fibrous structure 100 advantageously increases spreading of tows 102. However, increasing the strength of the ultrasonic vibration imparted to fibrous structure 100 also focuses the energy of the ultrasonic vibration to a small area and can locally distort the weave. Further, it can be advantageous in some examples to decrease the area of application to apply ultrasonic vibration to specific portions, regions, tows, etc. of fibrous structure 100 and, therefore, it can be advantageous to reduce the area of application of ultrasonic vibration. In some examples, there is optimal spreading of tows 102 when distance D is 7 mm. In other examples, there is optimal spreading of tows 102 when distance D is 1 cm.

Further, the width W of tip 308 can be selected to optimize spreading of tows 102 of fibrous structure 100. More specifically, the amount of ultrasonic vibration imparted to the surface of fibrous structure 100 and the area of application both increase as the width W of tip 308 increases. In some examples, there is optimal spreading of tows 102 when width W of tip 308 is between 0.25 inches and 0.5 inches.

The composition and depth of coupling medium 304 can further be selected to optimize tow spreading of fibrous structure 100. The composition of coupling medium 304 can be selected to increase the viscosity of coupling medium 304. Higher viscosity fluids are preferred in some examples, as higher viscosity fluids dampen vibrations from tip 308 and thereby help to control spreading of tows 102. In some examples, using water as coupling medium 304 is convenient. In other examples, coupling medium 304 can contain or be comprised entirely of an alcohol to lower the surface tension. In further examples, coupling medium 304 can be a polymer or another suitable flowing medium. Further, where coupling medium 304 is a liquid, using a lower liquid depth level can allow for a reduced distance D between tip 308 and fibrous structure 100. A lower liquid depth level can also increase the effective viscosity of coupling medium 304 due to the presence of the solid fibers of tows 102. In some examples, particles can be added to coupling medium 304 to help keep tows 102 spread following treatment with ultrasonic vibration. In examples where the coupling medium is a liquid, the particles can also function to keep tows 102 spread following drying of fibrous structure 100. The particles can formed from, for example, one or a combination of silicon carbide, boron carbide, hafnium oxide, hafnium boride, aluminum oxide, ytterbium oxide, and zirconium boride. Additionally and/or alternatively, the particles can be formed from a solid polymer such as polyvinyl alcohol. Particle sizes can range from 20 microns to 100 microns.

The amplitude of the ultrasonic vibrations by ultrasonic probe 302, the frequency of the vibrations emitted by ultrasonic probe 302, and the speed at which tip 308 is moved in step 406 of method 400 can further be selected to optimize application of ultrasonic vibration to the surface of fibrous structure 100. Higher amplitude vibrations result in greater spreading of tows 102 but also result in greater local distortion of tows 102. Higher frequency vibrations can also transfer greater energy to tows 102. The speed at which tip 308 is moved affects the amount of ultrasonic vibration that is imparted to any given point in pattern 500. More specifically, moving tip 308 at slower speeds allows for more ultrasonic vibration to be imparted to each point along pattern 500 while moving tip 308 at higher speeds reduces the amount of ultrasonic vibration imparted to each point along pattern 500 during each pass of pattern 500.

The power and frequency of the ultrasonic vibrations can further be selected based on the thickness of fibrous structure 100. For thicker or multilayer sheets, it can be advantageous to use more powerful and/or higher frequency ultrasonic vibrations. For example, the power of ultrasonic probe 302 can be in a range between 1 W and 200 W. In some examples, there is optimal spreading of tows 102 the power of ultrasonic probe 302 is between 2 W and 40 W, the frequency of the ultrasonic vibrations is between 20 kHz and 25 kHz, and tip 308 is moved at a speed of 20 mm/s.

The number of passes made with tip 308 over fibrous structure 100 (i.e., the number of times that the pattern in step 406 of method 400 is repeated) can further be selected to optimize application of ultrasonic vibration to the surface of fibrous structure 100. In some examples, using relatively low power vibrations with multiple passes over fibrous structure 100 can advantageously optimize the spreading of tows 102 while preventing coupling medium 304 from being excessively heated. Additionally and/or alternatively, the power of the ultrasonic vibrations and/or the number of passes can be selected to encourage heating of coupling medium 304. Promoting heating of coupling medium 304 can increase the rate of evaporation of coupling medium 304, which can be used to remove coupling medium 304 from fibrous structure 100 and thereby dry fibrous structure 100.

Further, method 400 can be adapted to affect the structure of tows 102 at specific regions or locations of fibrous structure 100, allowing for method 400 to be used to provide additional control over the structure of fibrous structure 100. For example, the speed at which tip 308 is moved, the shape of pattern 500, and/or the power of the ultrasonic vibrations ultrasonic vibrations can be varied as method 400 is be performed to locally distort regions of fibrous structure 100, allowing for increased tow spreading at those regions. As a specific non-limiting example, tip 308 can be held adjacent to one or more regions of fibrous structure 100 to provide locally-increased tow spreading. Other parameters of method 400 and/or pattern 500 can be adapted to provide localized spreading of tows 102 of fibrous structure 100 as required for a given application.

Although FIGS. 3-5 have been described herein with respect to a fibrous structure formed as a woven sheet, other suitable fibrous structures can be spread using system 300 and method 400. For example, system 300 and method 400 can be used to spread tows of, for example, braided fabric structures, fibrous preforms, three-dimensional fabric structures, multilayer fabrics, individual fiber tows, or unidirectional fiber materials. The preform can be, for example, a three-dimensional fibrous preform. In examples, where the fabric structure is braided, the fabric structure can have, for example, a biaxial or triaxial braided structure. In some examples where the fabric structure is a three-dimensional fabric structure, the fabric structure can have a generally cylindrical geometry. The fabric structure can be, in yet further examples, a woven layer or sheet, and tows 102 can be arranged in various woven architectures such as plain, harness (e.g., 3, 5, 8, etc.), twill, braid, or non-symmetric, among other examples. In other examples, method 400 can be performed while laying up fibrous material on a tool.

Further, although method 400 has been described herein generally as requiring movement of tip 308 of ultrasonic probe 302 in step 406, in some examples tip 308 is held in a fixed position and fibrous structure 100 is moved relative to the position of tip 308 according to a pattern. The pattern used to move fibrous structure 100 can be selected, for example, such that tip 308 traces out pattern 500 along the surface of fibrous structure 100. The speed at which fibrous structure 100 is moved can be selected as described previously with respect to the speed of tip 308. Where fibrous structure 100 is cylindrical, fibrous structure 100 can be rotated as tip 308 is held in a fixed position. System 300 can be adapted such that tip 308 is in a fixed position and fibrous structure can be moved relative to tip 308. In yet further examples, both tip 308 and fibrous structure 100 are moved during step 406 of method 400. In these examples, system 300 can be adapted so that fibrous structure 100 can be moved relative to tip 308.

Further, although method 400 has been described generally herein as using system 300, method 400 can be implemented in systems that do not use a bath. For example, fibrous structure 100 (or another suitable fibrous structure) can be pre-soaked to form a thin layer of coupling medium 304 on the surface of fibrous structure 100 to allow for ultrasonic tow spreading by ultrasonic probe 302. As described previously, in some examples, coupling medium 304 is air and ultrasonic probe 308 is adapted to impart ultrasonic vibration to fibrous structure 100 by in air and without a liquid coupling medium 304. Further, method 400 can be adapted to use an ultrasonic water bath rather than ultrasonic probe 302. Step 406 of method 400, moving tip 308, can be performed by a human operator or, in some examples, can be performed by a robotic system, such as a robotic arm. In some examples, the robotic system can be a multi-axis robot.

In yet further examples, system 300 can include a monitoring system to monitor the spreading of tows 102. The monitoring system can include, for example, one or more cameras or sensors used to monitor spreading of tows 102. Information from the monitoring system can be used to improve spreading of tows 102 by, for example, increasing the uniformity of tow spreading or increasing tow spreading in particular regions of fibrous structure 100. Information from the monitoring system can further be used to identify improper tow spreading that can then be corrected through further iterations of method 400 and/or operation of system 300.

In some examples, system 300 can be adapted can be used to spread tows of a fibrous tape or yarn. For example, a fibrous tape or yarn can be passed under tension from a source spool to a take-up spool through coupling medium 304. As the fibrous tape or yarn can is passed through coupling medium 304, ultrasonic vibration is imparted to the fibrous tape or yarn by tip 308 of an ultrasonic probe 302, spreading filaments of the fibrous tape or yarn. The fibrous tape or yarn can then be incorporated into a component and densified into a CMC. Advantageously, spreading the filaments of a fibrous tape or yarn improves the uniformity of densification of a component or preform made from the fibrous tape or yarn following filament spreading with ultrasonic vibration, thereby improving the strength and/or decrease the porosity of the resulting CMC.

Discussion of Possible Embodiments

The following are non-exclusive descriptions of possible embodiments of the present invention.

An embodiment of a method of spreading fiber tows includes applying a coupling medium to a surface of a fibrous structure, positioning an ultrasonic probe adjacent to the surface of a fibrous structure, such that a tip of the ultrasonic probe is in contact with in the coupling medium, moving at least one of the ultrasonic probe and the fibrous structure relative to the other of the ultrasonic probe and the fibrous structure according to a first pattern, and imparting ultrasonic vibration with the ultrasonic probe to the surface of the fibrous structure while moving the at least one of the ultrasonic probe and the fibrous structure. Imparting ultrasonic vibration to the surface of the fibrous structure spreads tows of the fibrous structure.

The method of spreading fiber tows of the preceding paragraph can optionally include, additionally and/or alternatively, any one or more of the following features, configurations and/or additional components:

A method of spreading fiber tows composition according to an exemplary embodiment of this disclosure includes, among other possible things, applying a coupling medium to a surface of a fibrous structure, positioning an ultrasonic probe adjacent to the surface of a fibrous structure, such that a tip of the ultrasonic probe is in contact with in the coupling medium, moving at least one of the ultrasonic probe and the fibrous structure relative to the other of the ultrasonic probe and the fibrous structure according to a first pattern, and imparting ultrasonic vibration with the ultrasonic probe to the surface of the fibrous structure while moving the at least one of the ultrasonic probe and the fibrous structure. Imparting ultrasonic vibration to the surface of the fibrous structure spreads tows of the fibrous structure.

A further embodiment of the foregoing method of spreading fiber tows wherein the fibrous structure comprises a plurality of warp tows and a plurality of weft tows and moving the at least one of the ultrasonic probe and the fibrous structure according to the first pattern comprises moving the at least one of the ultrasonic probe and the fibrous structure in a first direction, stepping the at least one of the ultrasonic probe and the fibrous structure in a second direction after moving the at least one of the ultrasonic probe and the fibrous structure in the first direction, and moving the at least one of the ultrasonic probe and the fibrous structure in a third direction antiparallel to the first direction after stepping the at least one of the ultrasonic probe and the fibrous structure in the second direction. The first direction is parallel with of one of the plurality of warp tows and the plurality of weft tows and the second direction is parallel with the other of the one of the plurality of warp tows and the plurality of weft tows.

A further embodiment of any of the foregoing methods of spreading fiber tows wherein moving the at least one of the ultrasonic probe and the fibrous structure according to the first pattern further comprises moving the at least one of the ultrasonic probe and the fibrous structure in the second direction, stepping the at least one of the ultrasonic probe and the fibrous structure in the first direction after moving the at least one of the ultrasonic probe and the fibrous structure in the second direction, and moving the at least one of the ultrasonic probe and the fibrous structure in a fourth direction antiparallel to the second direction after stepping the at least one of the ultrasonic probe and the fibrous structure in the first direction.

A further embodiment of any of the foregoing methods of spreading fiber tows, wherein applying the coupling medium to the surface of the fibrous structure comprises submerging the surface of the fibrous structure in the coupling medium.

A further embodiment of any of the foregoing methods of spreading fiber tows, wherein the coupling medium comprises includes particles configured to keep the tows of the fibrous structure spread after ultrasonic vibration is imparted to the tows A further embodiment of any of the foregoing methods of spreading fiber tows, wherein the fibrous structure comprises a plurality of warp tows and a plurality of weft tows, the plurality of warp tows are oriented in a first direction, the plurality of weft tows are oriented in a second direction, and moving the at least one of the ultrasonic probe and the fibrous structure according to the first pattern comprises moving the at least one of the ultrasonic probe and the fibrous structure in a third direction, stepping the at least one of the ultrasonic probe and the fibrous structure in a fourth direction after moving the at least one of the ultrasonic probe and the fibrous structure in the third direction, and moving the at least one of the ultrasonic probe and the fibrous structure in a fifth direction antiparallel to the third direction after stepping the at least one of the ultrasonic probe and the fibrous structure in the fourth direction. The third direction is angled intermediately between the first and second directions and the fourth direction is offset from the third direction by 90 degrees.

A further embodiment of any of the foregoing methods of spreading fiber tows, wherein imparting ultrasonic vibration to the surface of the fibrous structure comprises continuously imparting ultrasonic vibration to the surface of the fibrous structure.

A further embodiment of any of the foregoing methods of spreading fiber tows, wherein imparting ultrasonic vibration to the surface of the fibrous structure comprises pulsing ultrasonic vibration.

A further embodiment of any of the foregoing methods of spreading fiber tows, wherein imparting ultrasonic vibration with the ultrasonic probe comprises operating the ultrasonic probe at a power and a frequency, the power is between 1 W and 200 W, and the frequency is between 20 kHz and 25 kHz.

A further embodiment of any of the foregoing methods of spreading fiber tows, wherein the fiber tows comprise a ceramic material.

A further embodiment of any of the foregoing methods of spreading fiber tows, wherein the coupling medium comprises a liquid medium.

A further embodiment of any of the foregoing methods of spreading fiber tows, wherein the liquid medium comprises water.

An embodiment of system for spreading fiber tows includes a fibrous structure, a layer of a coupling medium on a surface of the fabric structure, and an ultrasonic probe at least partially in contact with in the layer of the coupling medium. The ultrasonic probe is configured to impart ultrasonic vibration to the fibrous structure through the layer of the coupling medium, while in contact with in the layer of the coupling medium, and the ultrasonic vibration is directed to cause tows adjacent to the ultrasonic probe to spread apart. At least one of the ultrasonic probe and the fabric structure the ultrasonic probe is configured to be moved relative to the other of the at least one of the ultrasonic probe and the fabric structure according to a first pattern.

The system for spreading fiber tows of the preceding paragraph can optionally include, additionally and/or alternatively, any one or more of the following features, configurations and/or additional components:

A system for spreading fiber tows according to an exemplary embodiment of this disclosure includes, among other possible things, a fibrous structure, a layer of a coupling medium on a surface of the fabric structure, and an ultrasonic probe in contact with in the layer of the coupling medium. The ultrasonic probe is configured to impart ultrasonic vibration to the fibrous structure through the layer of the coupling medium, while in contact with in the layer of the coupling medium, and the ultrasonic vibration is directed to cause tows adjacent to the ultrasonic probe to spread apart. At least one of the ultrasonic probe and the fabric structure the ultrasonic probe is configured to be moved relative to the other of the at least one of the ultrasonic probe and the fabric structure according to a first pattern.

A further embodiment of the foregoing system for spreading fiber tows, wherein the fibrous structure comprises a plurality of warp tows and a plurality of weft tows and the first pattern comprises moving the at least one of the ultrasonic probe and the fabric structure in a first direction, stepping the at least one of the ultrasonic probe and the fabric structure in a second direction after moving the ultrasonic probe, and moving the at least one of the ultrasonic probe and the fabric structure in the third direction antiparallel to the first direction after stepping the at least one of the ultrasonic probe and the fabric structure in the second direction. The first direction is parallel with of one of the plurality of warp tows and the plurality of weft tows and the second direction is parallel with the other of the one of the plurality of warp tows and the plurality of weft tows.

A further embodiment of any of the foregoing systems for spreading fiber tows, wherein the first pattern further comprises moving the at least one of the ultrasonic probe and the fabric structure in the second direction, stepping the ultrasonic probe in the at least one of the ultrasonic probe and the fabric structure after moving the at least one of the ultrasonic probe and the fabric structure in the second direction, and moving the at least one of the ultrasonic probe and the fabric structure in a fourth direction antiparallel to the second direction after stepping the at least one of the ultrasonic probe and the fabric structure in the first direction.

A further embodiment of any of the foregoing systems for spreading fiber tows, wherein the ultrasonic probe is configured to continuously impart ultrasonic vibration.

A further embodiment of any of the foregoing systems for spreading fiber tows, wherein the ultrasonic probe is configured to impart ultrasonic vibration in pulses.

A further embodiment of any of the foregoing systems for spreading fiber tows, wherein the warp tows and the weft tows comprise a ceramic material.

A further embodiment of any of the foregoing systems for spreading fiber tows, wherein the fibrous structure comprises a plurality of warp tows and a plurality of weft tows, the plurality of warp tows are oriented in a first direction and the plurality of weft tows are oriented in a second direction. The first pattern further comprises moving the at least one of the ultrasonic probe and the fabric structure in a third direction, stepping the at least one of the ultrasonic probe and the fabric structure in a fourth direction after moving the at least one of the ultrasonic probe and the fabric structure in the third direction, and moving the at least one of the ultrasonic probe and the fabric structure in a fifth direction antiparallel to the third direction after stepping the at least one of the ultrasonic probe and the fabric structure in the fourth direction. The third direction is angled intermediately between the first and second directions and the fourth direction is offset from the third direction by 90 degrees.

A further embodiment of any of the foregoing systems for spreading fiber tows, wherein the coupling medium comprises a liquid medium.

A further embodiment of any of the foregoing systems for spreading fiber tows, wherein the liquid medium comprises water.

A further embodiment of any of the foregoing systems for spreading fiber tows, further comprising a robotic arm configured to move the ultrasonic probe across the fibrous structure according to a first pattern.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of spreading fiber tows, the method comprising:

applying a coupling medium to a surface of a fibrous structure;

positioning an ultrasonic probe adjacent to the surface of the fibrous structure, such that a tip of the ultrasonic probe is in contact with the coupling medium;

moving at least one of the ultrasonic probe and the fibrous structure relative to the other of the ultrasonic probe and the fibrous structure according to a first pattern; and imparting ultrasonic vibration with the ultrasonic probe to the surface of the fibrous structure while moving the at least one of the ultrasonic probe and the fibrous structure, wherein imparting ultrasonic vibration to the surface of the fibrous structure spreads tows of the fibrous structure.

2. The method of claim 1, wherein:

the fibrous structure comprises a plurality of warp tows and a plurality of weft tows; and moving the at least one of the ultrasonic probe and the fibrous structure according to the first pattern comprises:

moving the at least one of the ultrasonic probe and the fibrous structure in a first direction, wherein the first direction is parallel with one of the plurality of warp tows and the plurality of weft tows;

stepping the at least one of the ultrasonic probe and the fibrous structure in a second direction after moving the ultrasonic probe, wherein the second direction is parallel with the other of the one of the plurality of warp tows and the plurality of weft tows; and moving the at least one of the ultrasonic probe and the fibrous structure in a third direction antiparallel to the first direction after stepping the ultrasonic probe in the second direction.

3. The method of claim 2, wherein moving the ultrasonic probe according to the first pattern further comprises:

moving the at least one of the ultrasonic probe and the fibrous structure in the second direction;

stepping the at least one of the ultrasonic probe and the fibrous structure in the first direction after moving the at least one of the ultrasonic probe and the fibrous structure in the second direction; and moving the at least one of the ultrasonic probe and the fibrous structure in a fourth direction antiparallel to the second direction after stepping the at least one of the ultrasonic probe and the fibrous structure in the first direction.

4. The method of claim 1, wherein the coupling medium comprises particles configured to keep the tows of the fibrous structure spread after ultrasonic vibration is imparted to the tows.

5. The method of claim 1, wherein:

the fibrous structure comprises a plurality of warp tows and a plurality of weft tows;

the plurality of warp tows are oriented in a first direction;

the plurality of weft tows are oriented in a second direction;

moving the at least one of the ultrasonic probe and the fabric structure according to the first pattern comprises:

moving the at least one of the ultrasonic probe and the fabric structure in a third direction, wherein the third direction is angled intermediately between the first and second directions;

stepping the at least one of the ultrasonic probe and the fabric structure in a fourth direction after moving the at least one of the ultrasonic probe and the fibrous structure in the third direction, wherein the fourth direction is offset from the third direction by 90 degrees; and moving the at least one of the ultrasonic probe and the fabric structure in a fifth direction antiparallel to the third direction after stepping the at least one of the ultrasonic probe and the fibrous structure in the fourth direction.

6. The method of claim 1, wherein imparting ultrasonic vibration to the surface of the fibrous structure comprises continuously imparting ultrasonic vibration to the surface of the fibrous structure.

7. The method of claim 1, wherein imparting ultrasonic vibration to the surface of the fibrous structure comprises pulsing ultrasonic vibration.

8. The method of claim 1, wherein:

imparting ultrasonic vibration with the ultrasonic probe comprises operating the ultrasonic probe at a power and a frequency;

the power is between 1 W and 200 W; and the frequency is between 20 kHz and 25 kHz.

9. The method of claim 1, wherein the fiber tows comprise a ceramic material.

10. The method of claim 1, wherein the coupling medium comprises a liquid medium.

11. The method of claim 10, wherein the liquid medium comprises water.

12. A system for spreading fiber tows, the system comprising:

a fibrous structure;

a layer of a coupling medium on a surface of the fibrous structure; and an ultrasonic probe in contact with the layer of the coupling medium, wherein:

the ultrasonic probe is configured to impart ultrasonic vibration to the fibrous structure through the layer of the coupling medium, while in contact with the layer of the coupling medium;

the ultrasonic vibration is directed to cause tows adjacent to the ultrasonic probe to spread apart; and at least one of the ultrasonic probe and the fabric structure is configured to be moved relative to the other of the at least one of the ultrasonic probe and the fabric structure according to a first pattern.

13. The system of claim 12, wherein:

the fibrous structure comprises a plurality of warp tows and a plurality of weft tows; and the first pattern comprises:

moving the at least one of the ultrasonic probe and the fabric structure in a first direction, wherein the first direction is parallel with one of the plurality of warp tows and the plurality of weft tows;

stepping the at least one of the ultrasonic probe and the fabric structure in a second direction after moving the at least one of the ultrasonic probe and the fabric structure in the first direction, wherein the second direction is parallel with the other of the one of the plurality of warp tows and the plurality of weft tows; and moving the at least one of the ultrasonic probe and the fabric structure in a third direction antiparallel to the first direction after stepping the at least one of the ultrasonic probe and the fabric structure in the second direction.

14. The system of claim 13, wherein the first pattern further comprises:

moving the at least one of the ultrasonic probe and the fabric structure in the second direction;

stepping the at least one of the ultrasonic probe and the fabric structure in the first direction after moving the ultrasonic probe in the second direction; and moving the at least one of the ultrasonic probe and the fabric structure in a fourth direction antiparallel to the second direction after stepping the ultrasonic probe in the first direction.

15. The system of claim 12, wherein the ultrasonic probe is configured to continuously impart ultrasonic vibration.

16. The system of claim 12, wherein the ultrasonic probe is configured to impart ultrasonic vibration in pulses.

17. The system of claim 12, wherein the warp tows and weft tows comprise a ceramic material.

18. The system of claim 12, wherein:

the fibrous structure comprises a plurality of warp tows and a plurality of weft tows;

the plurality of warp tows are oriented in a first direction;

the plurality of weft tows are oriented in a second direction; and the first pattern comprises:

moving the at least one of the ultrasonic probe and the fabric structure in a third direction, wherein the third direction is angled intermediately between the first and second directions;

stepping the at least one of the ultrasonic probe and the fabric structure in a fourth direction after moving the at least one of the ultrasonic probe and the fabric structure in the third direction, wherein the fourth direction is offset from the third direction by 90 degrees; and moving the at least one of the ultrasonic probe and the fabric structure in a fifth direction antiparallel to the third direction after stepping the at least one of the ultrasonic probe and the fabric structure in the fourth direction.

19. The system of claim 12, wherein the coupling medium comprises a liquid medium.

20. The system of claim 12, wherein the ultrasonic probe is configured to be moved relative to the fabric structure according to the first pattern, and further comprising a robotic arm configured to move the ultrasonic probe across the fibrous structure according to the first pattern.

* * * * *